United States Patent [19]

Yellin

[11] 4,145,977

[45] Mar. 27, 1979

[54] MODULAR SHELF SYSTEM WITH ASSEMBLY-DISASSEMBLY FEATURE

[75] Inventor: Bernard Yellin, Chicago, Ill.

[73] Assignee: Bernard Industries Co., Chicago, Ill.

[21] Appl. No.: 874,424

[22] Filed: Feb. 2, 1978

[51] Int. Cl.[2] ..... A47B 3/00

[52] U.S. Cl. ..... 108/111; 403/174

[58] Field of Search ..... 108/53.1, 53.5, 91, 108/101, 111; 211/194; 312/111; 403/174, 175, 178

[56] References Cited

U.S. PATENT DOCUMENTS

| | | | |
|---|---|---|---|
| 1,891,393 | 12/1932 | Oppenlander | 108/111 |
| 3,181,189 | 5/1965 | Leyden | 24/230 R |
| 3,367,701 | 2/1968 | Wenk | 24/230 R |
| 3,390,589 | 7/1968 | Tschanz | 24/230 R |
| 3,834,324 | 9/1974 | Lang | 108/111 X |
| 3,847,458 | 11/1974 | Nowak | 108/111 X |
| 3,927,625 | 12/1975 | Lang | 108/111 X |
| 4,010,698 | 3/1977 | Taub | 108/111 |

*Primary Examiner*—James C. Mitchell

*Attorney, Agent, or Firm*—Arnstein, Gluck, Weitzenfeld & Minow

[57] ABSTRACT

A modular shelf system formed of injection molded structural elements including shelf modules and column modules. The shelf modules have through openings and the column modules have interlocking ends which are received in said openings so that the column modules extend from both sides of a shelf module when assembled.

6 Claims, 12 Drawing Figures

MODULAR SHELF SYSTEM WITH ASSEMBLY-DISASSEMBLY FEATURE

SUMMARY OF THE INVENTION

This invention relates to a modular shelf system with assembly-disassembly feature.

The present invention comprises a modular system of injection molded plastic structural elements which may be assembled into a wide variety of structural configurations without the use of fasteners. By way of example, etageres or open shelving units may be arranged in single tiered or multiple side-by-side tiered configurations. The structural elements include shelf modules each having a vertical opening at each corner and column modules telescopically received in said openings and extending on both sides of a shelf module.

BRIEF DESCRIPTIONS OF THE DRAWINGS

FIG. 1 is a front elevational view of the structural elements comprising this system, in exploded relation.

FIGS. 2, 3, 3*a* and 4 are rear elevational views of the respective different structural elements illustrated in FIG. 1.

BRIEF DESCRIPTION OF A PREFERRED EMBODIMENT

Figure 1:
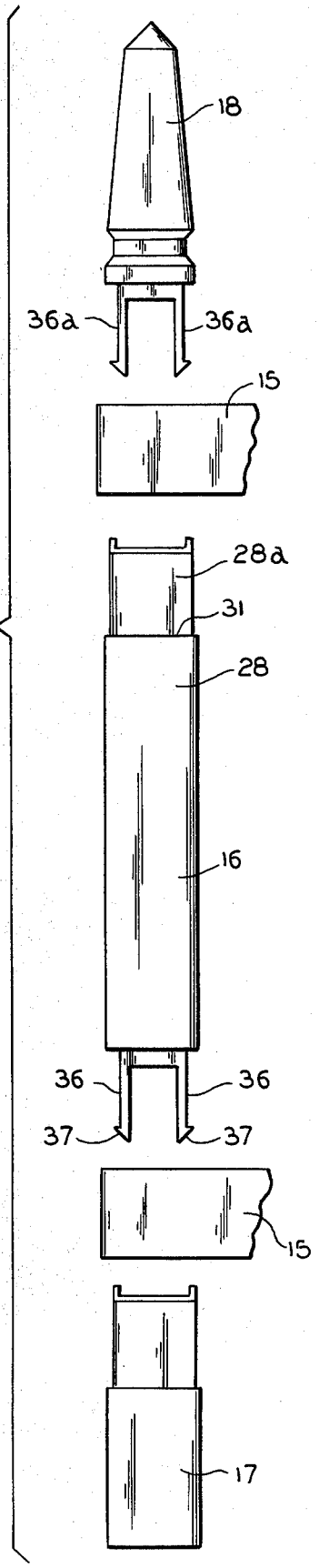
Figure 5:
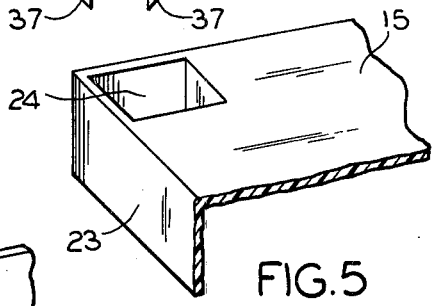
FIG. 5 is a fragmentary perspective view of a corner of a shelf module, as viewed from the top.
Figure 6:
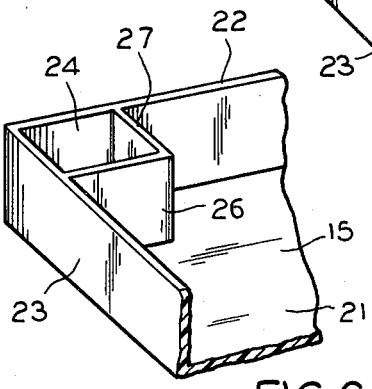
FIG. 6 is a similar view of the shelf module shown in FIG. 5, as viewed from the bottom.
Figure 9:
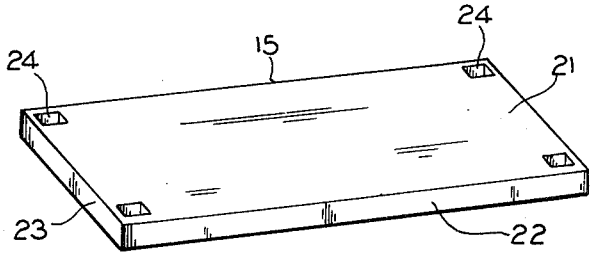
FIG. 9 is a perspective view of a shelf module.

The basic component elements of the system are illustrated in FIG. 1 and comprise one or more shelf modules 15, one or more space or column modules 16, a foot 17 and a cap 18. The shelf module 15 may be fabricated in one molding operation by any conventional plastic molding procedure utilizing any suitable known plastic material. As shown in FIGS. 5, 6 and 9, each shelf module 15 includes a planar member 21 and integral depending side and end walls 22 and 23 respectively. Each shelf module 15 is provided at each corner thereof with a vertical bore 24, generally rectangular in shape, and arranged to receive a supporting column module 16, hereinafter to be described. As shown clearly in FIG. 6, each bore 24 is defined by adjacent corner portions of the side and end walls and opposed integral wall portions 26 and 27.

Figure 3:
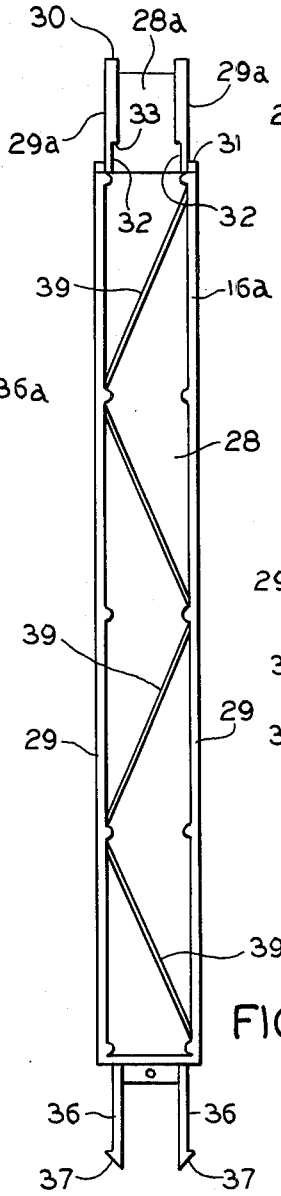
Figure 3A:
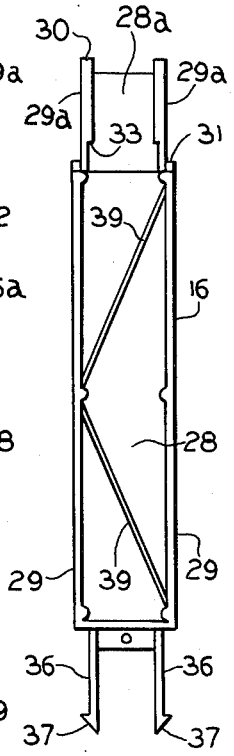
Figure 8:
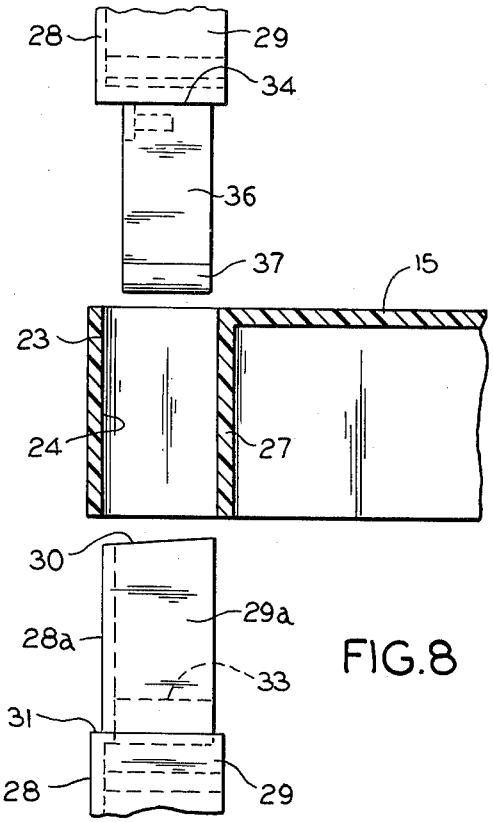
FIG. 8 is an exploded view of the joint illustrated in FIG. 7, but rotated 90 degrees.

Each corner of the shelf module 15 is intended to be assembled with a respective support member or column module illustrated in FIGS. 1, 3, and 3*a*. Each column module 16, 16*a* is fabricated in a molding operation from a suitable plastic material and is generally channel shaped in cross-section. The column modules 16 and 16*a* are substantially identical, except that module 16*a* has a length twice that of module 16. Each column module 16, 16*a* includes a front wall 28 and opposed longitudinally extending integral side walls 29. At the upper portion of a column module 16, 16*a* the front and side walls 28 and 29 respectively, are inwardly offset as at 28*a* and 29*a* to provide a continuous shoulder 31 which is coextensive with the front and two side walls. The lower portion of each inwardly offset side wall 29*a* is reduced in thickness as at 32 to provide a shoulder 33, with the shoulders 33, 33 being in opposed relation and in registration with each other and the upper edges 30 of said walls may be inclined as shown in FIG. 8. The lower end of the column module 16, 16*a* is provided with an end wall 34 and depending from said end wall are a pair of parallel legs 36, 36, each spaced inwardly of the side walls 29, 29 and terminating in a barbed portion 37. The distance between the outer surfaces of the legs 36 is such as to fit snugly in the space between the offset side walls 29*a* of a cooperating column module 16, 16*a*, as will be hereinafter explained. The legs 36 have a slight degree of flexibility so as to facilitate entry into said space. Molded integrally with the inner face of the front wall 28 are rigidifying ribs 39 which extend diagonally across the face. As will be apparent by reference to FIGS. 3 and 3*a*, the effective length of the column module 16*a* is twice that of column module 16 so that the spacing between adjacent shelf modules 15 may be varied as desired in assembling the completed configuration.

Figure 2:
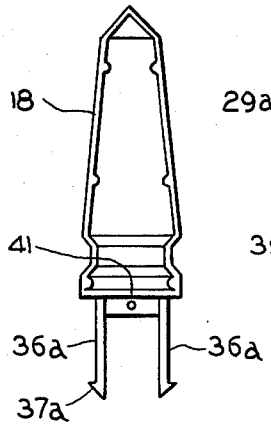

Referring to FIGS. 1 and 2 there is illustrated a decorative cap member 18 which is formed of molded plastic material, in any suitable configuration, and similarly, as in the case of the column modules 16, 16*a*, is preferably channel shaped in cross-section. The cap member 18 is provided with a bottom wall 41 from which depends a pair of legs 36*a* terminating in barbed portions 37*a* and corresponding identically to the legs of the column modules 16, 16*a*, hereinbefore described.

Figure 4:
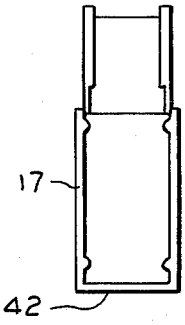

A foot member 17 illustrated in FIGS. 1 and 4 also is channel shaped and is provided with a bottom wall 42 which is adapted to rest on a floor surface. The construction of the upper portion of the foot element is identical to the corresponding wall portions of the column modules 16, 16*a*.

Figure 7:
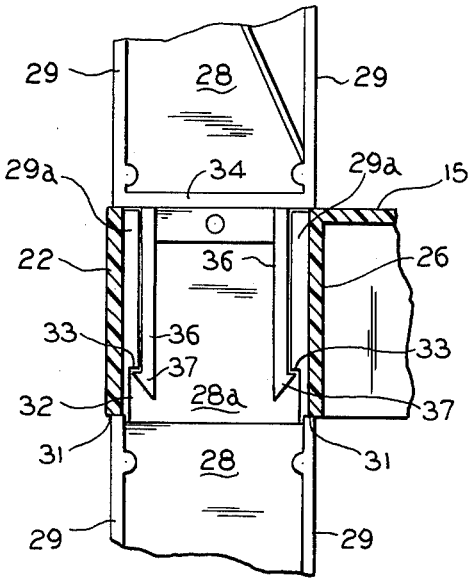
FIG. 7 is a fragmentary vertical cross-sectional view of an assembled joint.
Figure 10:
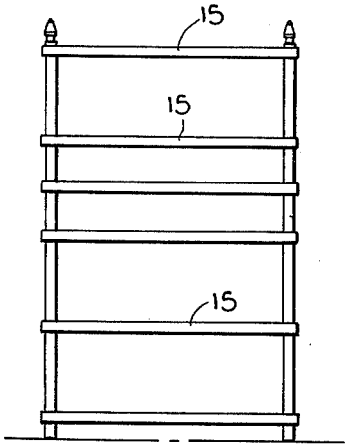
FIG. 10 is an elevational view of a single tiered open shelving configuration.
Figure 11:
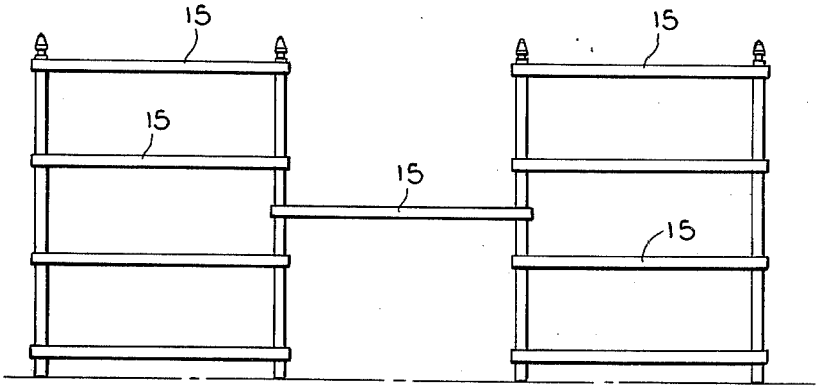
FIG. 11 is an elevational view of a multiple side-by-side tiered configuration.

The component modules of the system lend themselves to assembly in a large variety of configurations, only two of such configurations being illustrated in FIGS. 10 and 11. The operation of assembling the component modules consists simply in inserting the upper end 28*a*, 29*a* of a column module 16, 16*a* in a respective bore 24 in a shelf moldule so that the shelf module rests on the shoulder 31 of the column module. The legs 36 of an adjacent column module then are inserted in the space between the offset walls 29*a* of the lower column module to the point where the shoulders of the barbs 37 engage the respective shoulders 33 of the offset side walls 29*a*. It will be apparent that the legs 36 will be caused to flex slightly as the barbs 37 move into engagement with the shoulders 33. When engagement is effected the legs resume their normal condition substantially in the relationship illustrated in FIG. 7 with the components secured in assembled relation. It will be understood that the foot 17 and cap 18 are similarly assembled to complete a unit.

Referring to FIG. 10 it will be seen that the spacing between the shelf modules may be varied depending upon which length of column module is used. For example, for maximum spacing between shelves the column 16*a* illustrated in FIG. 3 is used while for half spacing the column module 16 illustrated in FIG. 3*a* may be used.

If it is desired to construct a different configuration or to disassembled the components for shipment or storage, it is only necessary to flex one of the legs 36 to disengage the barb 37 from one cooperating shoulder 33 and then to rock the component to effect disengagement of the opposite barb from its cooperating shoulder. Because each of the components is generally channel shaped in cross section the interior of each component is accessible and, therefore, the components may be readily disassembled merely by inserting a finger or any suitable tool into the open space of each component to engage one of the legs 36 for purposes of flexing the same.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a shelf system composable of modular elements, the combination of a pair of shelf modules placed one above the other, each of said shelf modules having a plurality of generally rectangular through vertical openings formed by depending wall portions, a plurality of column modules disposed between adjacent shelf modules, one end of each column module being hollow and having formed on opposite walls two internal opposed confronting detent shoulders, each of said walls being inwardly offset to form a support surface for a shelf module, said one end being received in a vertical opening of said shelf with the shelf resting on said support surface, the opposite end of each column module having a pair of longitudinally extending opposed fingers, each terminating in a barb, said fingers being inwardly offset to form shelf engaging surfaces, said fingers being adapted to be received in said hollow end of an adjoining column module so that the barbs mechanically interlock with respective detent shoulders to connect adjoining column modules while retaining a shelf module between said support surface and said shelf engaging surface.

2. The invention as defined in claim 1 in which the shelf module comprises a panel of generally rectangular shape and having an opening at each corner with each opening being generally rectangular.

3. The invention as defined in claim 1 in which each end of a column module includes a lateral surface so arranged that when two adjoining column modules are connected through a shelf module the shelf module is confined between said lateral surfaces.

4. The invention as defined in claim 1 in which the column module is open on one side and affords access to said barbs for effecting disengagement of said barbs from said shoulders for purposes of disassembly.

5. The invention as defined in claim 1 including a foot component having a hollow upper end adapted to be received in an opening of the lowermost shelf module, said upper end having formed on opposite walls two internal opposed shoulders adapted to be engaged by the barbs of an adjoining column module to effect securement.

6. The invention as defined in claim 1 including a cap having a pair of depending fingers each terminating in a barb, said fingers being adapted to be received in the hollow end of an adjoining column module and to be engaged by the barbs of an adjoining column module to effect securement.

* * * * *